US005417201A

United States Patent [19]

Thomas et al.

[11] Patent Number: 5,417,201

[45] Date of Patent: May 23, 1995

[54] PORTABLE WATER HEATING SYSTEM

[75] Inventors: Mark A. Thomas, Beaverton; Rick Regan, Aloha; Gordon Craft, Beaverton, all of Oreg.

[73] Assignee: SJS Industries, Beaverton, Oreg.

[21] Appl. No.: 162,453

[22] Filed: Dec. 3, 1993

[51] Int. Cl.[6] ..... F24H 1/00

[52] U.S. Cl. ..... 126/344; 126/5; 137/625.41; 251/155

[58] Field of Search ..... 126/9 R, 344, 639, 638, 126/640, 5, 365, 639, 25 R; 165/104.19, 104.21; 137/625.41, 592; 251/155

[56] References Cited

U.S. PATENT DOCUMENTS

| | | | |
|---|---|---|---|
| 705,350 | 7/1902 | Hubert | 126/639 |
| 1,204,779 | 11/1916 | Junkers . | |
| 1,853,480 | 4/1932 | Wheeler et al. | 126/638 |
| 2,189,490 | 2/1940 | Hart . | |
| 3,118,430 | 1/1964 | Russell et al. . | |
| 3,192,916 | 7/1965 | Vitkay | 126/5 |
| 3,246,644 | 4/1966 | Peterson | 126/9 R |
| 3,291,112 | 12/1966 | Springer | 126/5 |
| 3,687,128 | 8/1972 | Williams . | |
| 3,763,848 | 10/1973 | Williams . | |
| 3,768,458 | 10/1973 | Williams . | |
| 4,520,793 | 6/1985 | Hall . | |
| 4,599,870 | 7/1986 | Hebert et al. . | |
| 4,599,994 | 7/1986 | Cole | 126/639 |

FOREIGN PATENT DOCUMENTS 1054632 11/1983 U.S.S.R. ..... 126/639

OTHER PUBLICATIONS

"Solid Fuel Thermosiphon," Heating the Home Water Supply, Chapter 2, pp. 11–36; Appendix, Heating the Home Water Supply, pp. 107–117.

*Primary Examiner*—James C. Yeung
*Attorney, Agent, or Firm*—Klarquist Sparkman Campbell Leigh & Whinston

[57] ABSTRACT

A portable thermosyphon water heating system for use by outdoor enthusiasts, or others at locations remote from a conventional supply of hot water. Water is heated by an open campfire flame in an enclosed heat exchanger, and is circulated between the heat exchanger and a portable non-pressurized reservoir by thermosyphon action. The hot water returning to the reservoir is discharged through a floating transfer conduit assembly, so the discharge rises and falls with the water level in the reservoir. The floating nature of the hot water return allows the majority of water within the reservoir to be used before refilling is needed, while maintaining thermosyphon action. A method of heating a liquid using the system described above is also provided, along with a retrofit apparatus for retrofitting existing reservoirs to use the thermosyphon principles and components of the present invention.

3 Claims, 4 Drawing Sheets

FIG. 5
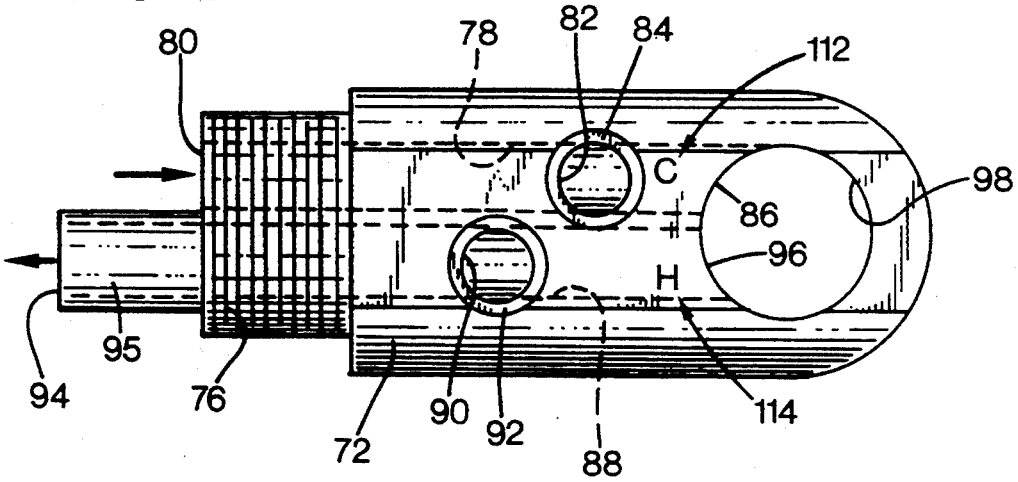
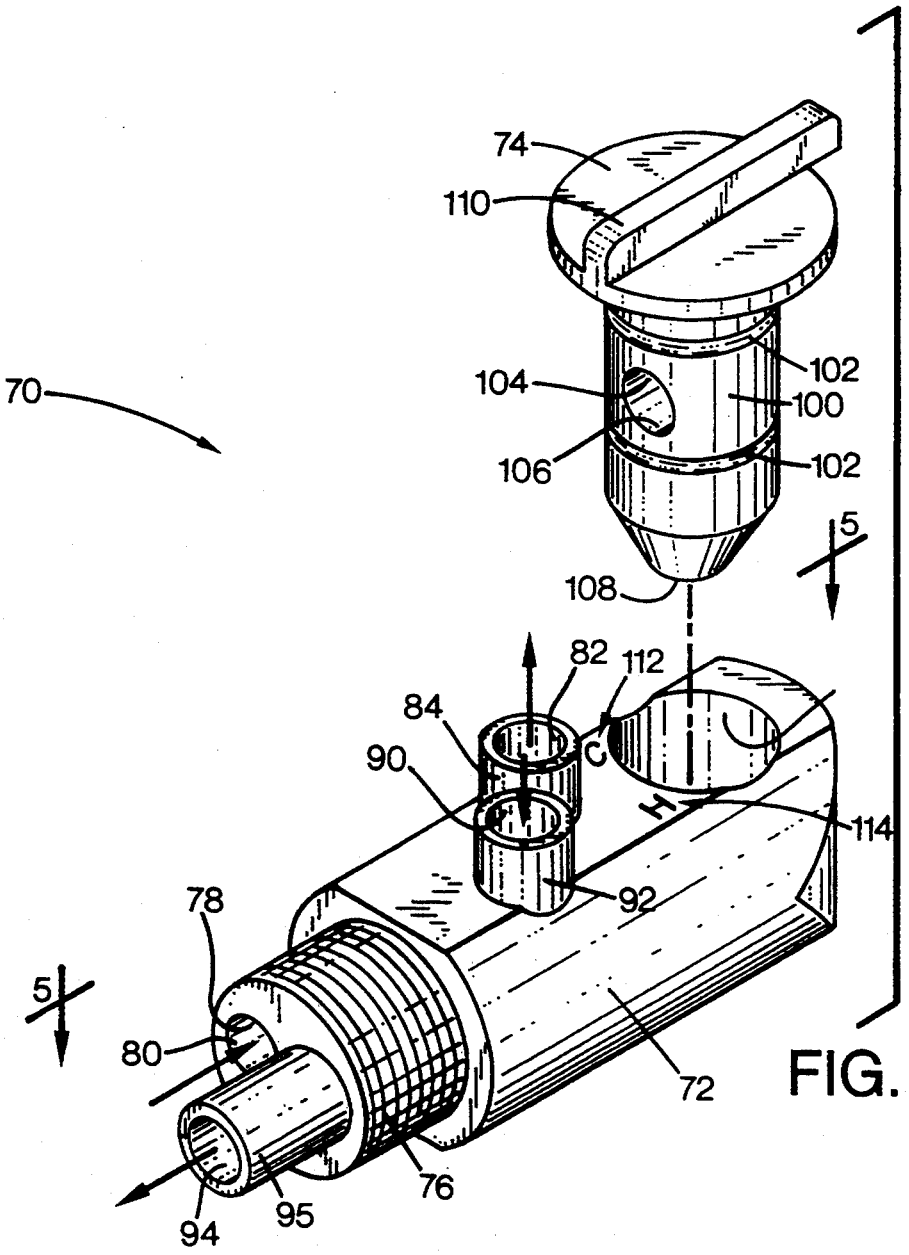
FIG. 4

PORTABLE WATER HEATING SYSTEM

BACKGROUND OF THE INVENTION

The present invention relates generally to a portable solid-fuel thermosyphon system, and more particularly to a thermosyphon system for use by outdoor enthusiasts, such as campers, hunters, and others, for instance, soldiers or missionaries, located remote from a conventional hot water source.

The concepts of a conventional solid-fuel thermosyphon which heats water by gravity flow is disclosed in Larry Gay's book entitled, *Heating the Home Water Supply* (Garden Way Publishing, 1983). Such of a conventional thermosyphon water heating system typically is constructed at a permanent location, i.e., it is not portable.

Such a conventional gravity flow system operates on the premise that, as water is heated, it becomes less dense and flows upwardly. This closed loop water heating system has a tank coupled to a heat exchanger coil, which is placed within a stove. The tank has a cold water outlet near the bottom of the tank and a hot water inlet near the top of the tank. A piping system connects the cold water outlet to the coil, and then conducts water from the coil through a riser portion of the piping to the tank hot water inlet. This flowing action then draws cold water from the lower portion of the tank into the heat exchanger coil.

Unfortunately, in conventional closed loop systems, the only usable hot water that may be extracted from the tank is that located above the hot water inlet. Otherwise, if the water level in the tank drops below the hot water inlet, the syphon action will cease, resulting in system failure.

Regarding portable water heating systems, such as those used for camping, outdoor enthusiasts typically obtain hot water by heating water in an open container. Unfortunately, this method takes time and does not provide hot water on demand.

Others have sought to overcome these shortcomings and provide hot water for outdoor enthusiasts. These earlier systems primarily use an open flame with a coil heat exchanger. For example, such a system is disclosed in U.S. Pat. No. 3,687,128. Typically, the open flame is generated from a gas-fired source, which requires a pressurized gas supply. Furthermore, for adequate circulation of the water through the heat exchanger, these devices also require the water storage tanks to be a pressurized vessel. Pressurized vessels and a pressurized gas supply are heavy, bulky and thus, burdensome to transport. Moreover, for extended stays at remote locations, maintaining a pressurized gas supply may not be feasible.

Other sources of hot water are generated using solar collectors, with one typical system being shown in U.S. Pat. No. 4,520,793. Unfortunately, solar water heaters depend upon passive solar energy collection, and their efficiency is severely affected by poor environmental conditions, e.g., cloud covered days, evenings, cold weather, etc. While solar powered thermosyphon systems have been effectively used in home water heating systems using home solar collectors, the size of an efficient solar panel prohibits such heating systems from being portable. Moreover, these home solar collectors typically require a considerable amount of time to heat the water to an adequate temperature for use.

While these earlier devices may be satisfactory for the particular purposes and installations for which they were intended, to the best of the inventors knowledge, there has not been a portable, compact hot water heating system available for use by outdoor enthusiasts and the like, which does not require the use of pressurized fuel and/or a pressurized water tank.

Thus, a need exists for a portable water heating system, and more particularly a solid fuel, non-pressurized, portable water heater, that can provide hot water on demand using a campfire or the like as a heat source, which is directed toward overcoming, and not susceptible to, the above limitations and disadvantages.

SUMMARY OF THE INVENTION

According to one aspect of the present invention, a thermosyphon system for heating a liquid includes a reservoir for containing the liquid. The system has a heat exchanger for placing in a heat source, with the heat exchanger having a passageway for receiving the liquid therein to transfer heat energy from the heat source to the liquid. The system includes a conduit coupling the reservoir to the heat exchanger to transfer the liquid therebetween. The system also has a self-adjusting hot liquid discharge device coupled to the conduit and extending into the reservoir to return liquid from the heat exchanger, with the discharge device rising and falling with the level of the liquid in the reservoir.

According to another aspect of the present invention, a method is provided of heating a liquid using a portable liquid heating system, such as that described above.

According to a further aspect of the present invention, a retrofit apparatus is provided for retrofitting an existing liquid heating reservoir with a heat exchanger, a conduit and a self-adjusting hot water discharge device, which may be as described above.

One object of the present invention is to provide a lightweight portable liquid heating system which uses a non-pressurized reservoir and a solid-fuel heat source.

Another object of the present invention is to provide a portable liquid heating system which allows nearly all of the liquid stored within a system reservoir to be used before refilling is required.

A further object of the present invention is to provide a portable water heating system which allows hot water, cool water, or a combination thereof, to be selectively extracted for use.

Still another object of the present invention is to provide a method of heating a liquid when conventional liquid heating systems are not available.

Another object of the present invention is to provide a retrofit kit for retrofitting existing water heating reservoirs to increase their efficiency and the amount of useful hot water available.

The present invention relates to the above features and objects individually, as well as collectively. These and other objects, features and advantages of the present invention will become apparent to those skilled in the art from the following description and drawings.

BRIEF DESCRIPTION OF THE DRAWINGS

FIG. 4 is an exploded perspective view of an inlet/-outlet and spigot assembly of the system shown in FIG. 3.

FIG. 5 is a top plan view taken along lines 5—5 of FIG. 4.

DETAILED DESCRIPTION OF THE PREFERRED EMBODIMENTS

Figure 1:
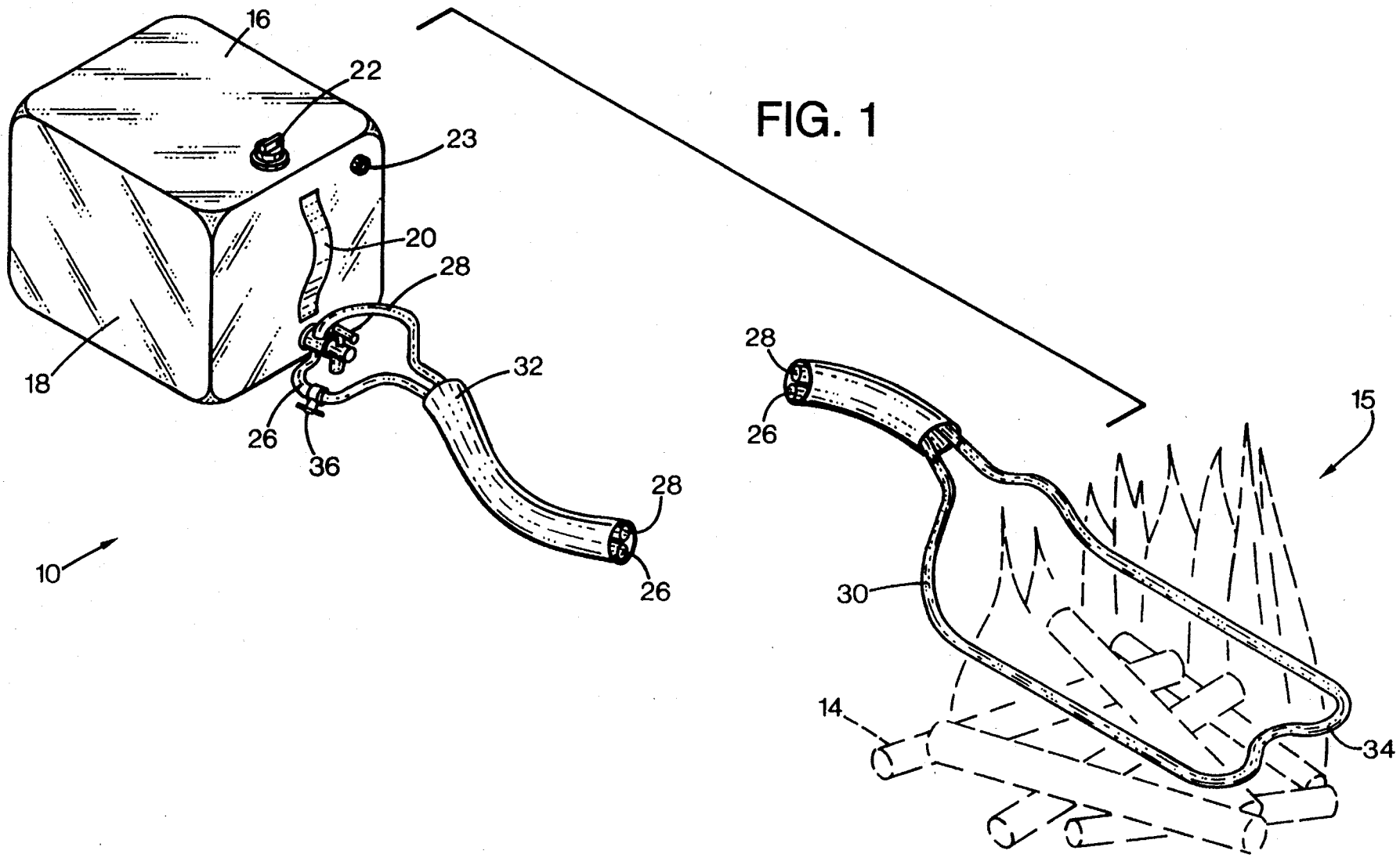
FIG. 1 is a fragmented perspective view of one form of a portable liquid heating system of the present invention.
Figure 2:
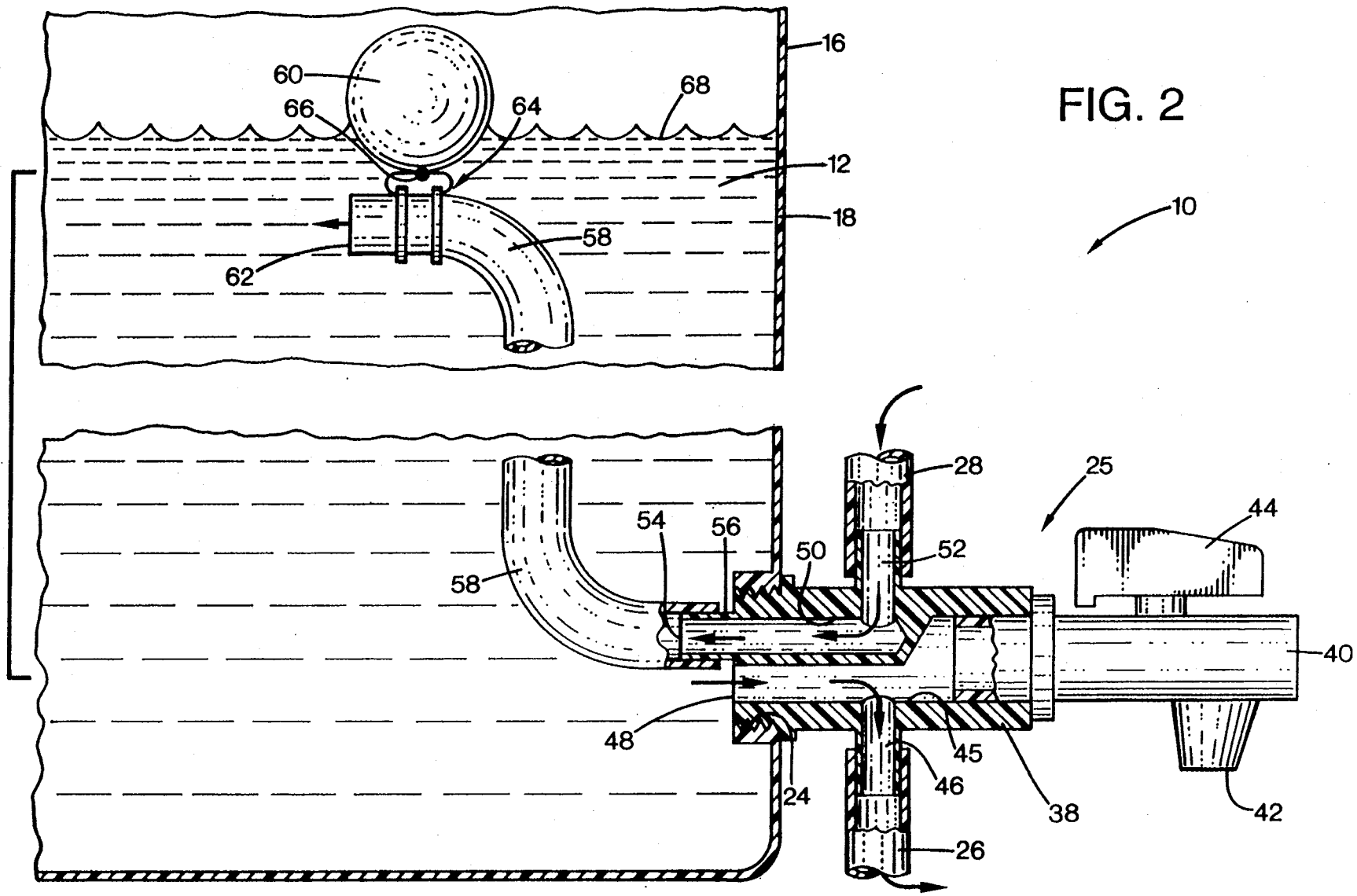
FIG. 2 is a fragmented cutaway side elevational view of a portion of the system of FIG. 1.

Referring to FIGS. 1 and 2, a portable liquid heating system 10 constructed in accordance with the present invention is shown for heating a liquid 12, illustrated herein as water. While the liquid 12 herein is illustrated as water, it is apparent that other liquids, such as flavored beverages, may be heated using the system 10. The system 10 may be used with a solid fuel heat source 14, illustrated herein as wood burning as a campfire 15. The system 12 includes a vessel, reservoir or tank 16 for receiving the liquid 12 therein.

As best shown in FIG. 2, the reservoir 16 has a liquid-impervious wall 18 which defines the reservoir chamber for receiving the water 12. In one preferred embodiment, a reservoir having a five-gallon capacity has proved to be a particularly useful size, being both easily carried and containing an amount of water sufficient for several people while camping. Such a reservoir has dimensions of approximately ten inches by ten inches by twelve inches. One particularly preferred material for the reservoir 16 is a polyethylene approved for containing edible liquids by the U.S. Food and Drug Administration ("FDA"), which can easily withstand the range of water temperatures typically encountered.

For convenience, the reservoir 16 may include one or more handles 20, for ease of transportation. Preferably, the reservoir 16 also has a capped inlet portion 22, which may also include a conventional pressure relief valve for relieving excess pressure stored within the reservoir. Alternatively, a separate pressure relief valve 23 may be located in a side or upper wall of the reservoir 16, separate from the inlet cap 22. The reservoir wall 18 has an inlet/outlet port 24 therethrough, which is preferably surrounded by an internally threaded coupling or pipe fitting. An inlet/outlet and spigot mechanism 25, described further below, is threadably received within the port 24.

A cold water supply line 26 and a hot water return line 28 couple a heat exchanger coil 30 to the spigot mechanism 25. The terms "cold" or "cool" and "hot" are used herein as relative terms, with liquid in the hot water return line 28 understood to be of a warmer temperature than the "cool" water flowing in the cold water supply line 26. As the water within reservoir 16 is heated, the "cold" water in line 26 may well approximate in temperature what is known as "lukewarm" or "tepid" water.

The supply and return lines 26, 28 are preferably constructed of a flexible tubing, such as polyethylene tubing approved by the Food and Drug Administration (FDA) for containing edible liquids. To accommodate the possible high temperatures adjacent to the heating coil 30, a portion of lines 26, 28 coupled to coil 30 may be of a high-temperature flexible material, preferably with an operational temperature range of 150° F. to 500° F. This temperature range is believed to be sufficient for lines 26, 28 to adequately withstand the heat generated close to a conventional wood-fueled campfire 15. Silicon tubing, approved by the FDA, is capable of withstanding this temperature range, and alternatively, silicon tubing may be used for the entire length of lines 26, 28.

In the preferred embodiment:, the supply and return lines 26, 28 may be around five feet long. Particularly useful dimensions for the lines 26, 28 may include a $\frac{3}{4}$ inch outer diameter, with a $\frac{5}{8}$ inch inner diameter, for example. Alternatively, the tubing of lines 26, 28 may have a $\frac{3}{8}$ inch inner diameter. When segments of tubing form a single line, 26 or 28, such as silicone tubing coupled to the coil 30 and polyethylene coupled to the reservoir, a simple slip connector, known to those skilled in the art, may be inserted within the inner diameter ends of the polyethylene and silicon tubing segments to join them together. A flexible sheath 32 of a rubber, canvas, polyethylene or the like may be slipped over the supply and return lines 26, 28 to protect them from damage.

The heat exchanger 30 comprises a metallic body with a cavity formed therein for circulating the water 12 therethrough. An example of a suitable material for the heat exchanger 30 is 20-gauge $\frac{5}{8}$-inch outer diameter, T-304 stainless steel tubing. Alternatively, the heat exchanger tubing 30 may be of a $\frac{3}{8}$ inch outer diameter T-304 stainless steel, which can easily withstand the typical 1700° F. temperatures generated by the coals of an open campfire 15.

One set of preferred dimensions for the coil 30 is approximately 15–20 inches in length, with a width of 8–12 inches, and a serpentine portion 34, which may be shallow as illustrated in FIG. 1, or a full serpentine having a depth of 10–12 inches or :more. It is apparent that other designs of heat exchangers may be readily substituted for the illustrated loop configuration 30, such as a full serpentine (not shown), or as a platen or hollow-plate type heat exchanger (not shown).

Depending upon the relative dimensions of the lines 26, 28 and the coil 30, the lines 26, 28 may be slipped over the ends of the heat exchanger tubing. A conventional hose clamp or other fastening device (not shown) may then be used to secure the supply and return lines 26, 28 to coil 30.

The water heating system 10 may also include an adjustable flow restriction device incorporated in either one of the supply or return lines 26, 28, such as the flow restriction device 36 coupled in the cold water supply line 26 of FIG. 1. The restriction device 36 may be a manual stopcock valve, or an automatic bimetallic flow restriction device, known to those skilled in the art, or a combination thereof. When the water temperature within reservoir 16 rises to an acceptable level, the bimetallic flow restriction device 36 senses this desirable temperature, and in response thereto, restricts flow of the water from the reservoir 16 to the heat exchanger 30.

Referring to FIG. 2, the spigot mechanism 25 includes a body 38 having a conventional spigot mechanism 40 coupled at one end thereof. The spigot 40 is used for dispensing liquid 12 from the reservoir 16 through a faucet portion 42 when activated by a handle 44. The body 38 defines a cold water passageway or chamber 45 coupled to the spigot mechanism 40 and a cold water supply outlet 46. The chamber 45 has an inlet 48 which extends into the lower portion of the chamber of reservoir 16. FIG. 2 includes several arrows to show the relative directions of normal liquid flow through the spigot mechanism 40.

The spigot body 38 also defines a hot water return chamber 50 with an inlet portion 52 coupled to the hot water return line 28. The sleeve portions 46 and 52 are preferably sized to be inserted within the supply and return lines 26, 28. The chamber 50 also has an outlet 54 defined by a sleeve portion 56 which preferably extends into the reservoir 16. The sleeve 56 forms a coupling point for a flexible hot water return transfer line 58. The transfer hose 58 may be constructed of polyethylene or silicon tubing, as described above for the supply and return lines 26, 28, although the silicon tubing is preferred.

The system 10 includes a floating device or float 60. The float 60 is coupled to a discharge end 62 of the transfer tubing 58 using a conventional clamping mechanism 64, or other fastener known to those skilled in the art. The float 60 is illustrated as a spherical float of polypropylene. It is apparent that other shapes and materials may be used for float 60, such as three inch by two inch by one inch floating polyethylene block. Preferably, the float 60 is a weighted float, with the weight being supplied by the hose 58, or by the addition of separate weights 66.

As the liquid is heated, it flows upwardly under the force of the pressure generated from the expanding nature of the hot water in the heat exchanger 30. The hot water is then transferred to the discharge 62 near the upper surface 68 of the reservoir. The returning hot water then applies gravity pressure to transfer additional cold water to the inlet 48.

Advantageously, suspending the hot water return discharge 62 at a substantially constant distance below an upper surface 68 of the liquid in reservoir 16 maintains thermosyphon action as the liquid level 68 drops from usage. Thus, the effective useful volume of liquid 12 in reservoir 16 is effectively increased from that illustrated in the prior art conventional thermosyphon system of FIG. 7. Indeed, thermosyphon action continues until the water level drops below the level of the cold water inlet 48 of the spigot mechanism 25, so it is advantageous to mount the spigot mechanism 25 in a lower portion of the reservoir.

Figure 3:
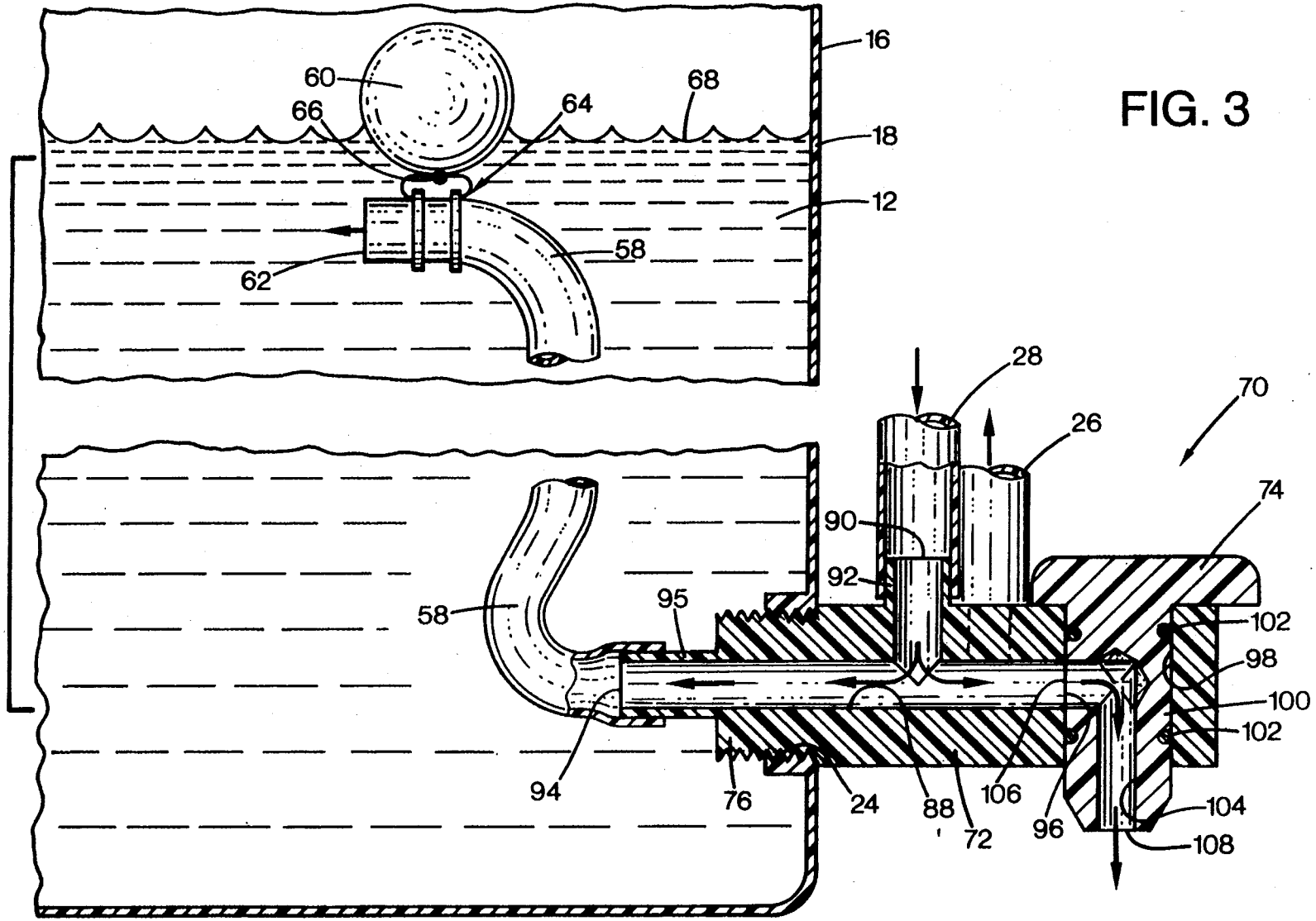
FIG. 3 is a fragmented cutaway side elevational view of a portion of an alternative embodiment of a portable liquid heating system of the present invention.

Referring now to FIG. 3, an alternative embodiment of a spigot mechanism 70 is illustrated as being coupled to reservoir 16. The spigot 70 is also coupled to the transfer line 68 and float 60, as well as the cold and hot lines 26, 28. FIGS. 4 and 5 illustrate the spigot mechanism 70 in greater detail. The spigot mechanism 70 includes a body portion 72 and a conventional handle and faucet dispenser assembly 74. The body 72 has a threaded boss portion 76 which is threadably engaged within port 24 of the reservoir 16.

The spigot body 72 defines a cold water passageway or chamber 78. The chamber 78 has an inlet 80 extending into reservoir 16, and an outlet 82 defined by a sleeve portion 84. The cold water chamber also includes a usage outlet port 86 for use as described further below. The body 72 defines a hot water return passageway or chamber 88. The hot water chamber 88 has an inlet 90 defined by sleeve 92, and a primary outlet 94 defined by sleeve 95. The sleeve portions 84, 90 and 95 preferably are sized to be inserted within the supply, return and transfer lines 26, 28 and 58, respectively. The hot water return chamber 88 also includes a usage outlet 96. FIG. 3 includes several arrows to show the relative directions of normal liquid flow through the spigot mechanism 70.

The body 72 also defines a cylindrical bore 98 into which the cold and hot water usage outlets 86 and 96 open. The bore 98 is sized to rotatably and slidably receive a body portion 100 of the usage valve 74. The body portion 100 may have grooves formed therein for receiving conventional O-ring sealing rings 102 to prevent leakage from the spigot assembly 70. The body 100 defines a passageway 104 with an inlet 106 and a faucet outlet 108.

Indicia may be provided on the upper surface of the spigot body 72, located adjacent a pointer portion 110 of the handle 74 when the spigot mechanism 70 is assembled. For example, the indicia may be the letter "C" 112 for cold water, and the letter "H" 114 for hot water, used to indicate the direction for turning the handle 74. By selectively rotating the position of the spigot inlet 106 to be adjacent either the cold water outlet 86 or the hot water outlet 96, or across a combination thereof, a desired temperature of water may be extracted through the outlet 108. It is apparent that, depending upon the operational condition of the system 10, the hot water flowing through the chamber outlet 96 may be either that returning from the heat exchanger 30, or from an upper portion of the reservoir 16.

While the spigot assemblies 25 and 70 are illustrated as preferred embodiments, it is also apparent that the hot and cold water lines 26, 28 may enter the reservoir 16 through separate ports (not shown). In such an alternate embodiment, the hot water inlet 28 is coupled to an internal floating discharge conduit, such as transfer line 58 suspended by float 60, as described above. Moreover, in such an embodiment, the flow restriction device 36 may incorporate a spigot mechanism (not shown) for dispensing liquid from the system 10.

A 10-gallon reservoir 16 according to the invention is typically heated by a campfire with coals at temperatures reaching in excess of 1500° F. Beginning with cold water having a temperature of roughly 65° F., the device generates hot water at the hot water discharge 62 of around 100° F. after 30 minutes. After one hour of operation, the average water temperature within the vessel is approximately 100° F., with the water near the top of the reservoir 16 being around 130° F. After an hour and a half, the "cold" water near the bottom of the container has increased in temperature to around 75° F.

After several hours of operation, the average water temperature within the reservoir 16 reaches a plateau of approximately 140° F. This is a sufficient temperature to be extremely useful to outdoor enthusiasts and others for washing, ingesting, and the like, and yet not so hot as to present a serious safety hazard of burns to the user.

Thus, using the FIG. 2 spigot mechanism 25, the faucet 42 extracts cooler water for drinking from the reservoir 10. The spigot mechanism 70 acts as a mixing valve to provide a desired temperature of water, ranging from cool near the bottom of the reservoir to hot at the top of the reservoir, with the exact upper and lower temperatures depending upon the heating duration, ambient temperature, amount of liquid remaining, etc. Thus, the spigot mechanism 70 advantageously takes advantage of the temperature differences of the thermal layers of the water 12 in vessel 16, which may be particularly advantageous, since these layers can sometimes differ by as much as 50° F. In this manner, a user may be provided with hot and "cold" (lukewarm) running water on demand from the system 10.

Another aspect of the present invention may be realized by making the threaded portions of the spigot bodies 25 and 70, such as the boss 76, of a standard dimension to fit existing reservoirs and water tanks. In accordance with the present invention, a retrofit apparatus may be fashioned using components as described herein to retrofit existing tanks with a thermosyphon system. Such a retrofit apparatus or kit would preferably include either spigot mechanism 25 or 70, the floating hot water transfer line 58 with float 60, the supply and return lines 26, 28, heat exchanger 30, and, optionally, the flow restriction device 36. Thus, using these components, an existing reservoir could be retrofit for heating a liquid using a method of the present invention, described below.

The present invention also provides a method of heating a liquid, including the steps of containing a liquid within reservoir 16 and of burning solid fuel 14, preferably as a campfire 15. In a positioning step, the heat exchanger 30 is positioned in the campfire 15. IN a coupling step, the supply and return lines 26, 28 are coupled to spigot mechanism 25 or 70. A portion of the liquid 12 is removed a lower portion of the reservoir 16 by thermosyphon action. In a circulating step, the liquid 12 is circulated between the reservoir 16 and the heat exchanger 30 by thermosyphon action, and then returned to the reservoir through a hot liquid discharge 62. In an adjusting step, the level of the hot liquid discharge 62 in the liquid is adjusted within the reservoir to rise and fall with the liquid level 68 within the reservoir.

A preferred embodiment of this method includes a suspending step, where the hot liquid discharge is suspended from a device floating along the surface 68 of the liquid. The method may also include the steps of raising and lowering the hot water outlet in the reservoir in response to the respective filling and emptying of the reservoir, including the step of periodically extracting liquid from the reservoir through a spigot mechanism. In a preferred embodiment, either cold water from the bottom portion of the reservoir or hot water from the upper portion of the reservoir, or a combination thereof, may selectively be extracted from the reservoir. The method also includes the step of periodically refilling the reservoir, either through inlet 22 or port 24 (preferably with the spigot mechanism removed) to replenish the supply of liquid therein.

Having illustrated and described our invention with respect to the preferred embodiments, it should be apparent to those skilled in the art that our invention may be modified in arrangement and details without departing from such principles. For example, the reservoir container 16 may be of other shapes and sizes, such as a cylindrical tank with a three-gallon volume. As another example, the capped filling port 22 and the pressure relief port 23 may be incorporated into the inlet/outlet spigot mechanisms 25, 70 using conventional devices known to those skilled in the art. Also, the heat exchanger coil 30 may be shaped into a spiral coil configuration, and be of different diameters than those illustrated. Moreover, suitable material substitutions and dimensional variations for the components of the portable water heating system 10 may be employed. We claim all such modifications falling within the scope and spirit of the following claims.

We claim:

1. A thermosyphon system for heating a liquid, comprising:

a reservoir for containing the liquid;

a heat exchanger for placing in a heat source, with the heat exchanger having a passageway for receiving the liquid therein to transfer heat energy from the heat source to the liquid;

a conduit Coupling the reservoir to the heat exchanger to transfer the liquid therebetween; and a self-adjusting hot liquid discharge device coupled to the conduit and extending into the reservoir to return liquid from the heat exchanger, the discharge device rising and falling with the level of the liquid in the reservoir, wherein:

the reservoir comprises a non-pressurized vessel having a wall defining a port located in a lower portion of the reservoir;

the heat source comprises a wood-fueled campfire, and the heat exchanger comprises a metallic body for being placed in the campfire;

the conduit couples the reservoir port to the heat exchanger;

the hot liquid discharge device is coupled to the reservoir port and includes a float which maintains a substantially constant distance between an upper surface of the liquid in the reservoir and the hot liquid discharge; and the system further includes a dispensing device coupled to the port for selectively dispensing cool liquid from a lower portion of the reservoir, hot liquid either returning from the heat exchanger or from an upper portion of the reservoir, or a combination of said cool and hot liquids.

2. A thermosyphon system according to claim 1, wherein the reservoir comprises a non-pressurized vessel and includes a refill inlet for replenishing the liquid to the system and a pressure relief valve for relieving any excess pressure within the system.

3. A thermosyphon system according to claim 1, wherein the heat exchanger comprises a serpentine style heat exchanger.

* * * * *